US010752439B2

(12) United States Patent
Musso et al.

(10) Patent No.: US 10,752,439 B2
(45) Date of Patent: Aug. 25, 2020

(54) SHIELD FOR THREE COMPARTMENT REAR LOAD PACKER

(71) Applicant: AIR-FLO MANUFACTURING CO., INC., Elmira Heights, NY (US)

(72) Inventors: Tom W. Musso, Bath, NY (US); Charles S. Musso, Jr., Corning, NY (US); Thomas Lee Price, Jr., Mentone, AL (US)

(73) Assignee: Air-Flo Manufacturing Co., Inc., Elmira Heights, NY (US)

( * ) Notice: Subject to any disclaimer, the term of this patent is extended or adjusted under 35 U.S.C. 154(b) by 270 days.

(21) Appl. No.: 15/645,222

(22) Filed: Jul. 10, 2017

(65) Prior Publication Data

US 2019/0009983 A1 Jan. 10, 2019

(51) Int. Cl.

| | |
|---|---|
| ***B65F 3/20*** | (2006.01) |
| ***B65F 3/00*** | (2006.01) |
| ***B65F 3/24*** | (2006.01) |

(52) U.S. Cl.

CPC ..... *B65F 3/20* (2013.01); *B65F 3/001* (2013.01); *B65F 3/205* (2013.01); *B65F 3/24* (2013.01)

(58) Field of Classification Search

CPC ..... B65F 3/208; B65F 3/001

See application file for complete search history.

(56) References Cited

U.S. PATENT DOCUMENTS

| | | | | | |
|---|---|---|---|---|---|
| 2,212,058 | A * | 8/1940 | Wood | B65F 3/20 | 414/525.5 |
| 3,756,438 | A * | 9/1973 | Steltz | B30B 9/3082 | 414/525.5 |
| 4,460,307 | A * | 7/1984 | Durant | B65F 3/20 | 414/525.54 |
| 5,123,801 | A * | 6/1992 | O'Daniel | B65F 3/001 | 414/512 |
| 7,118,320 | B2 * | 10/2006 | Tomassoni | B65F 3/001 | 414/517 |
| 2005/0220593 | A1 * | 10/2005 | MacPherson | B65F 3/001 | 414/525.52 |
| 2014/0348621 | A1 * | 11/2014 | Brisson | B65F 3/201 | 414/525.6 |

* cited by examiner

*Primary Examiner* — Jonathan Snelting

(74) *Attorney, Agent, or Firm* — Alix, Yale & Ristas, LLP

(57) ABSTRACT

A shield for a compartment opening of a refuse truck body, comprising an upper segment hinged to the truck body and a lower segment hinged to the upper segment. A source of power selectively pivots the lower segment relative to the upper segment. This enables a first angle of articulation whereby the upper segment covers an upper region of the compartment opening and the lower segment covers a lower region of the compartment opening whereby the shield covers the entire opening of the compartment; a second angle whereby the upper segment covers the upper region of the opening and the lower segment is positioned such that refuse can be swept beneath the lower segment into the lower region of the opening; and a third angle whereby the upper and lower segments fully uncover the compartment opening, whereby refuse can be freely dumped out of the compartment.

10 Claims, 11 Drawing Sheets

SHIELD FOR THREE COMPARTMENT REAR LOAD PACKER

BACKGROUND

The present invention relates to trucks for refuse packing, and especially to truck bodies adapted to pack recyclable refuse.

Some communities desire the separate recycling of three kinds of materials: metals, paper goods, and organics. Truck bodies are known for providing three compartments for receiving, packing, and ejecting the three types of materials. Typically such bodies have one sump, one sweep blade and one pack blade for each of a central and two side compartments that are loaded and unloaded at the rear of the body. Whereas each compartment can be loaded simultaneously and packed simultaneously by the tailgate packing unit at a single stop of the truck, the compartments must be unloaded in sequence, at different locations within the recycling facility, while the packing unit is rotated away from the body.

To some extent during packing and certainly during unloading, the openings at the rear of the compartments must be controlled such that refuse being packed into or unloaded from one opening does not intermingle with refuse associated with another opening.

SUMMARY

It thus an object of the present invention to provide a closure configuration at a rear opening of a multi-compartment refuse truck body, that efficiently and cost-effectively controls the opening and closing of the side openings during the packing and unloading of refuse while avoiding intermingling of refuse associated with a different opening.

According to the present disclosure, a composite shield is provided for each side compartment. The shield is disclosed as comprising an upper segment having top and bottom ends, a lower segment having top and bottom ends, a first hinge member at the top end of the upper segment, for pivotal connection to the truck body, and a second hinge member operatively connecting the upper segment and the lower segment, whereby a source of power selectively pivots the second hinge member and thereby angulates the lower segment relative to the upper segment.

This shield segments can be fixed in least two relative positions, corresponding to at least two modes of operation. A first mode depends on a first angle of articulation whereby the upper segment covers an upper region of the compartment opening and the lower segment covers a lower region of the compartment opening whereby the shield covers the entire opening of the side compartment. A second mode depends on a second angle of articulation whereby the upper segment covers the upper region of the compartment opening and the lower segment is angled upwardly such that the bottom end of the lower segment is positioned above the edge of the floor, whereby refuse can be swept over the edge of the floor into the compartment through the lower opening of the compartment, beneath the lower segment.

Preferably, the second hinge member is fixed to the lower segment and the source of power includes an actuator carried on the upper segment for selectively angulating the lower segment relative to the upper segment.

Another embodiment is directed to a refuse truck body having multiple compartments (i.e., a main compartment and at least one side compartment), with a congruent elongated shield of the type summarized above, for the opening of each side compartment. Each shield comprises a rigid upper segment having a top end that is hinged at the edge of the roof with a first pivot joint whereby the upper segment can pivot toward and away from the opening, and an opposite bottom end. A rigid lower segment is hinged to the upper segment, having a top end confronting the bottom end of the upper segment and extending to a bottom end at the edge of the compartment floor, with a second pivot joint that can be fixed at a predetermined angle relative to the upper segment.

In the context of a three-compartment refuse truck body with associated packer tailgate or unit, each shield is in a position for a mode whereby the shield is fixed or held with an angled outer segment, to provide a stationary guide such that the sweep and pack blade push or pack refuse under the outer segment into the compartment. In another, fully protected dump mode of operation, both shield segments are fixed or held to the body in a substantially straight configuration thereby closing both side compartments, the packing unit is rotated or lifted and the center compartment is dumped. In yet another, partially protected dump mode of operation, the entire shield for one side compartment is freely hinged to the body and thereby passively lifted by the discharging refuse while the other shield remains closed. In a fourth, unprotected mode of operation, the hinge on the previously closed shield is freed and passively lifted by the discharging refuse (whether or not the previously opened section has been reset to act as a guide).

DETAILED DESCRIPTION

Figure 1:
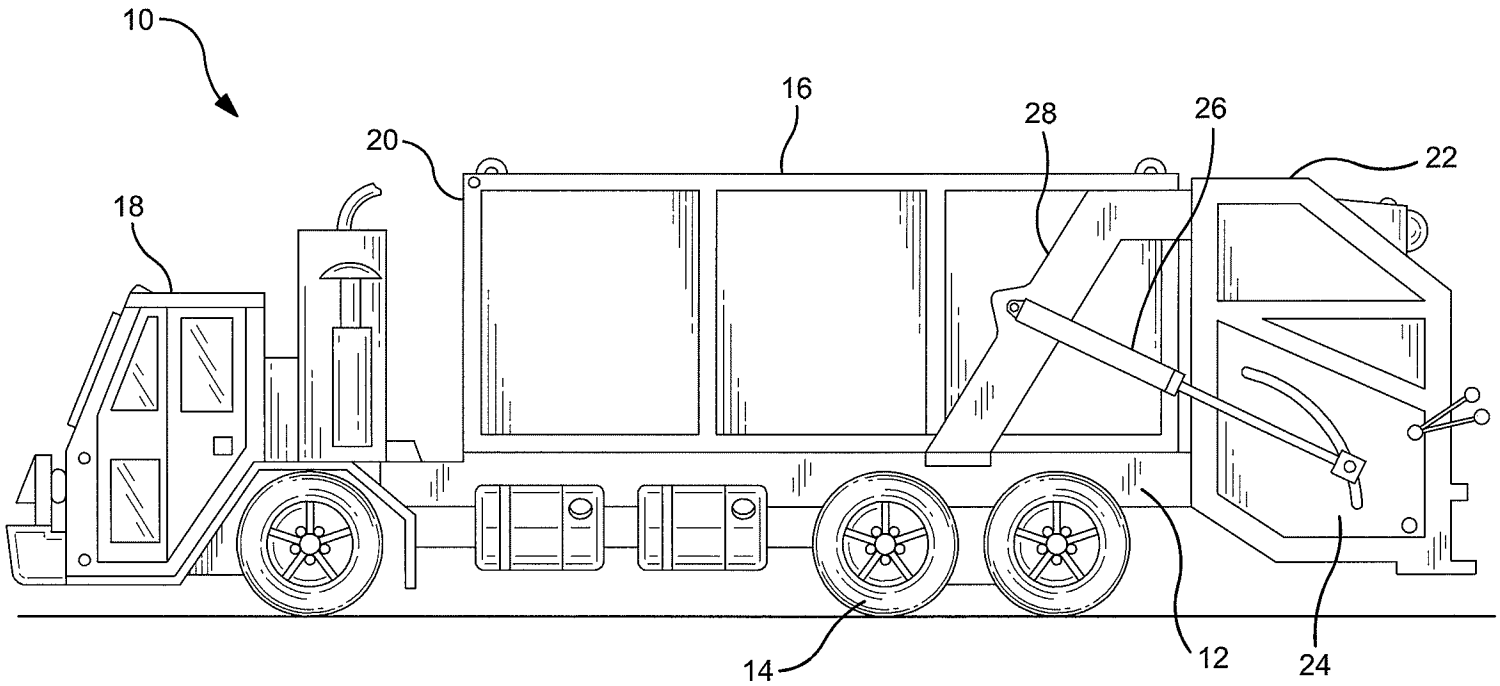
FIG. 1 PRIOR ART
FIG. 1 shows a conventional single compartment, rear-loading garbage packing truck.

FIG. 1 shows a conventional single compartment, rear-loading garbage truck 10, including chassis 12, wheels 14, body 16, and cab 18. The body extends longitudinally from a front end 20 to a back end 22, where a compaction unit 24 is integral with the body or supported by the chassis or both the body and chassis. Hydraulic cylinders 26 are mounted to the body or other support structure 28 to operate the compaction unit.

Figure 2:
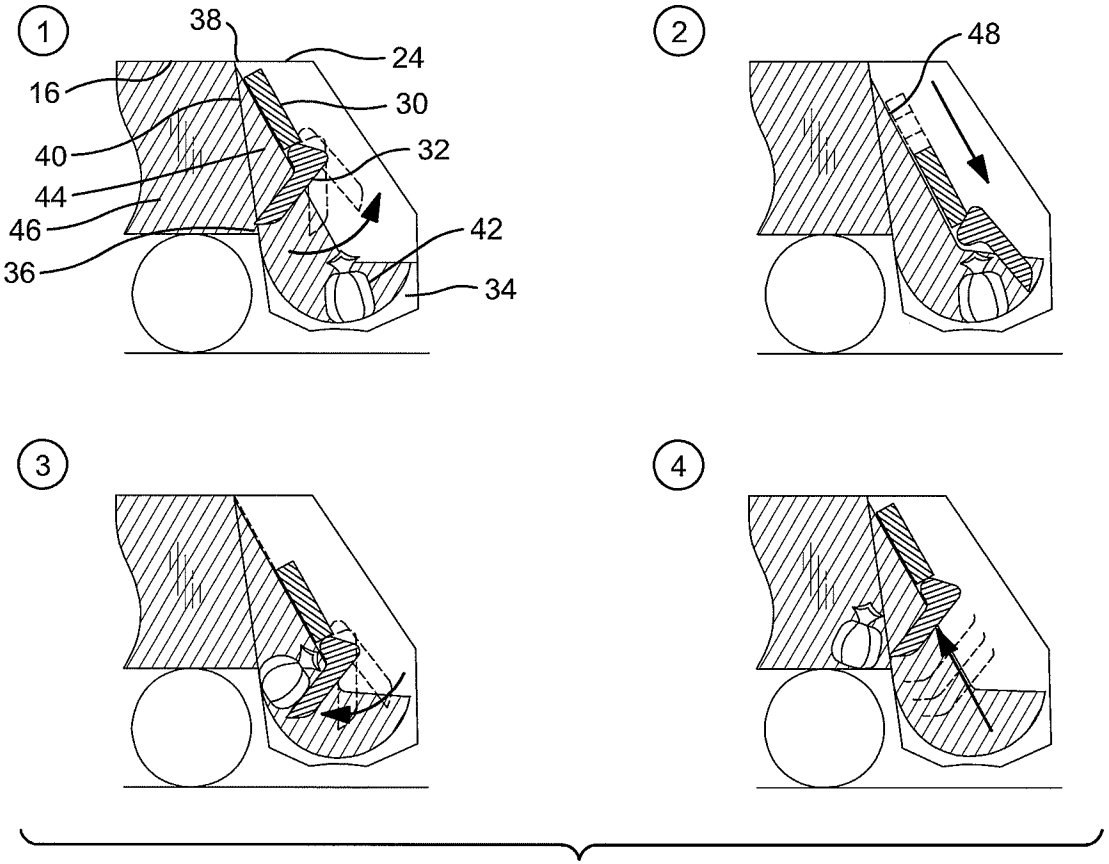
FIG. 2 PRIOR ART
FIG. 2 is a schematic representation of the steps in a packing cycle according to the present invention.

FIG. 2 is a schematic representation of the steps 1-4 in a packing cycle according to the present invention, which is directed to a sweep type compaction unit that can be incorporated into the overall truck and body represented in FIG. 1. The set of hydraulic cylinders 26 at the periphery of the body 16 can be adapted to operate the pack blade 30 and another set of cylinders (not shown) operate the sweep blade 32 through sump 34 into the compartment in body 16. The upper edge of the sweep blade 32 is pivotally connected along a transverse axis, to the bottom edge of the pack blade 30. The present invention is an improved truck body or compaction unit with efficient multi-compartment capability.

Figure 3:
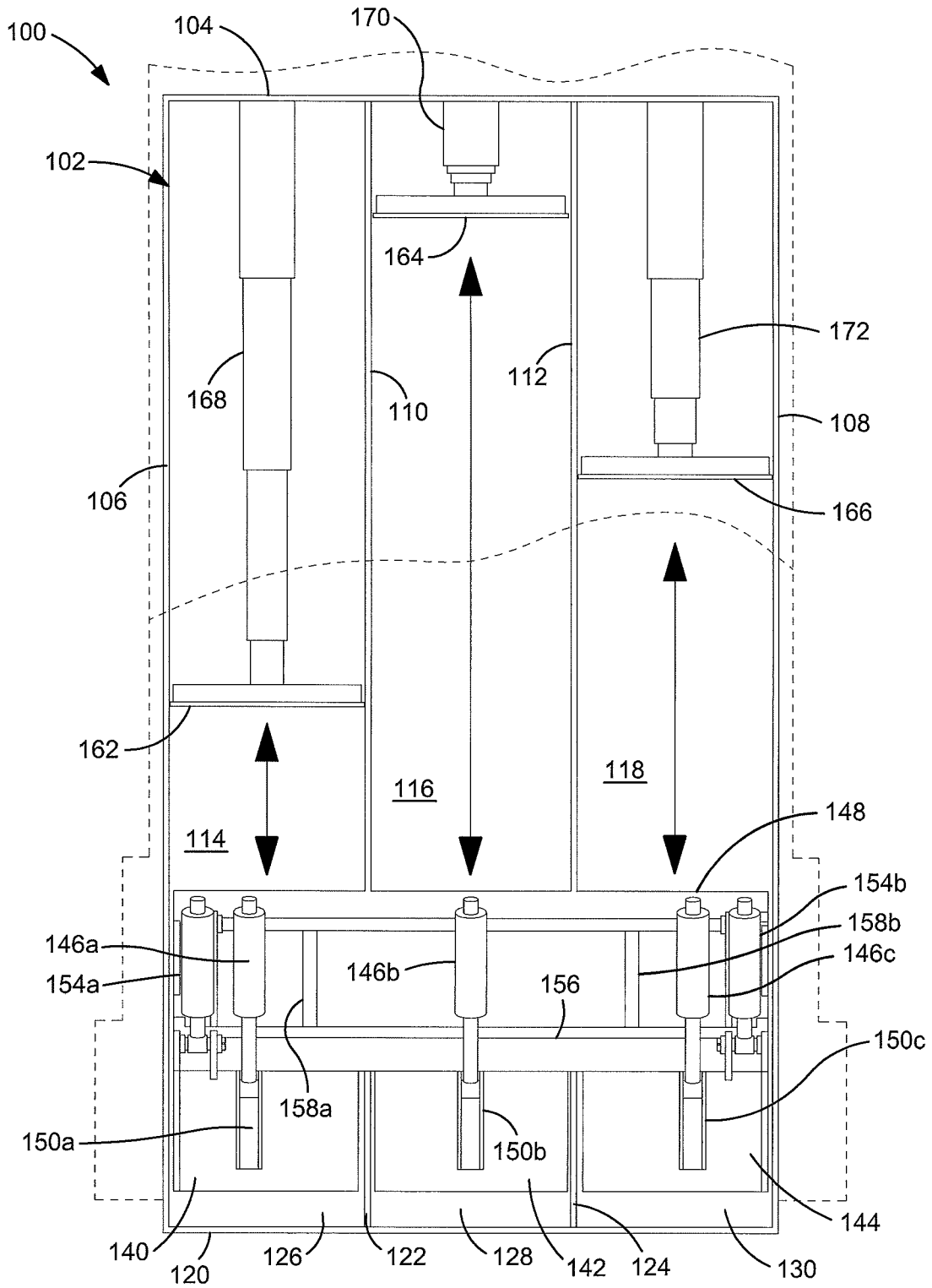
FIG. 3 is a schematic plan view representation of a rear loading three compartment truck body configuration.

FIG. 3 shows the truck body with the roof removed, for three packer compartments extending longitudinally from the front toward the back of the body. The general operating principles will be described with respect to FIGS. 2 and 3. Each compartment has a height defined between a loading floor 36 and a ceiling 38, at a rear opening 40. Three collection sumps 34 at the back of the body, situated rearward of and below the compartment openings 40, receive a respective three loads 42 of segregated refuse (per steps 1 and 2 of FIG. 2). Two laterally spaced divider walls 44 extend from the sumps to the ceilings of the compartments at the compartment openings, thereby defining three respective loading channels from the sumps to the compartments. The main body has two longitudinal walls 46 aligned with the divider walls 44. Sweep blade 32 extends laterally across all the sumps 34, and has three sections corresponding to the three collection sumps, wherein the sweep blade sections are movable respectively within each sump.

A first drive system is provided for pivoting each sweep blade section through each respective collection sump toward the floor of a respective the compartment (as shown in step 3 of FIG. 2). A respective (or preferably a single) pack blade 30 is displaceable in a linear oblique path toward and away from the sump 34. The pack blade is retracted upwardly and the sweep blade pivoted toward the floor 36 for collection of refuse (per step 1 of FIG. 2). The pack blade 30 is extended and the sweep blade is also extended in substantial alignment with the pack blade, and then pivoted toward the floor 36 in a sweeping action as shown in steps 2 and 3 of FIG. 2. As shown in step 4 of FIG. 2, the pack blade 30 is then retracted and in cooperation with the perpendicularly angled sweep blade 32, pushes the swept refuse through the channels between divider walls 44 into compartment openings 40 while maintaining segregation of the refuse between the divider walls. The rearward edges 48 of divider walls 44 are positioned and inclined so that the oblique upward displacement of the pack blade 30 closely follows the edges of the divider walls.

It can be appreciated that the pack blade has a lower edge that is pivotally connected along a transverse axis to an upper edge of the sweep blade; a first drive system pivots the sweep blade around the transverse axis, over an included angle that follows the shape of the sump; and a second drive system displaces the pack blade with sweep blade obliquely from the sump to the floors of the compartments.

The body has a frame 102 with front wall 104 and side walls 106, 108. Two laterally spaced internal walls 110, 112 cooperate with the side and front walls to define three longitudinally extending packing compartments 114, 116, 118. At the back end 120, two longitudinally extending, laterally spaced dividers 122, 124 align with the walls 110, 112, respectively. The dividers separate three distinct collection sumps 126, 128, 130. The dividers 122, 124, extend or are otherwise connected to the walls 110, 112, so that three channels are formed, each having an associated sump and packing compartment.

Figure 4:
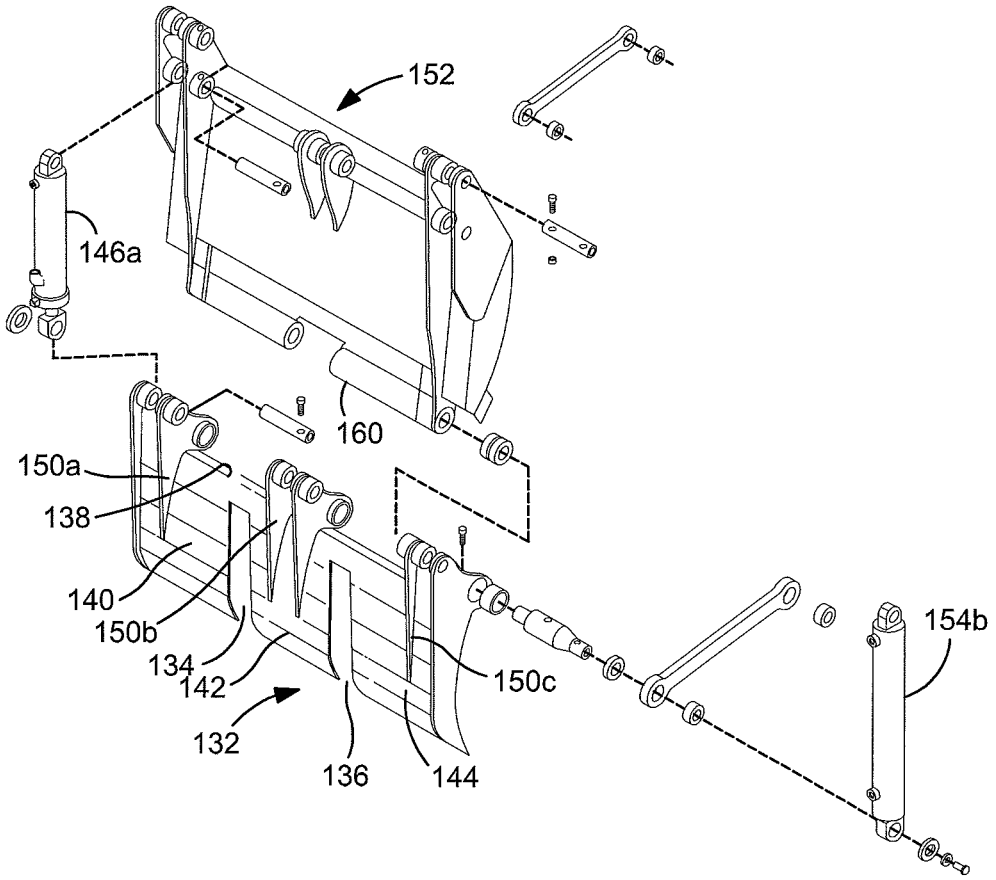
FIG. 4 is an exploded view of the preferred combination of single pack blade and segmented sweep blade.

As shown in FIG. 4, the preferred sweep blade 132 is an integral unit that extends laterally the full width of the body and has two laterally spaced slits 134, 136 which extend vertically from the bottom edge of the blade at least half way to but terminating below the top edge 138 of the blade. This defines three sweep blade sections 140, 142, 144, preferably having a curvature adapted to sweep within the respective three curved collection sumps 126, 128, and 130 as the slits 134, 136 pass over dividers 122, 124. In this manner, a different type of recyclable can be placed in a different collection sump, and separately swept toward respective packer compartments 114, 116, and 118 as the respective sweep blade cylinders 146*a*, 146*b*, and 146*c* sweep the entire sweep blade 132. Three sweep blade cylinders are shown but fewer can be provided. The sweep blade cylinders are supported within the frame on cross brace 148, with linkages and associated actuation arms 150*a*, 150*b*, and 150*c* connected to the back side, for sweeping blade 132.

The pack blade 152 extends laterally across the body above the sweeper blade 132, for oblique movement toward and away from the compartments. Pack blade cylinders 154*a*, 154*b* are shown mounted inside the body or frame for this purpose and connect to an additional cross brace 156, but the pack blades can alternatively be mounted outside the frame. Braces 158*a*, 158*b* are also provided. The lower edge 160 of the packer blade is in essence pivotally connected along a transverse axis to the upper edge 138 of the sweep blade for cooperative movement as described with respect to FIG. 2.

Refuse in each compartment 114, 116, 118 is packed as the pack blade 30, 152 and sweep blade 32 as sectioned per 140, 142, 144, push the refuse into the openings 40 at the rear of the compartments. The refuse is pushed against packing faces 162, 164, 166 on the ejection cylinders 168, 170, 172. The cylinders retract as the compartments fill with packed refuse. When the truck is full, the entire compaction unit 24 (FIG. 2) rotates upwardly to expose the compartment openings 40. The ejection cylinders 168, 170, 172 are extended in sequence to push the refuse out the back end of the truck into three different dumping stations for the respective three different kinds of refuse.

When the compaction unit 24 is raised open for refuse ejection of the three compartments, there is a tendency for all three compartments to start spilling refuse. This is undesirable, as the type of refuse in each compartment is different and must be offloaded separately.

According to the present disclosure, as shown in FIGS. 5-8, a composite shield 182*a*, 182*b* is provided for each side compartment, with an inner or upper segment 184 to prevent refuse being packed in the body from exiting the tailgate and a pivotally connected and powered outer or lower segment 186 that allows at least two modes of operation including completely closing of the compartment or completely opening of the compartment.

The shield upper segment 184 has top and bottom ends 188, 190, and the lower segment 186 has top and bottom ends 192, 194. A first hinge mechanism 196 at the top end of the upper segment provides a pivotal connection to the truck body, and a second hinge mechanism 200 operatively connects the upper segment 184 and the lower segment 186, whereby a source of power 202 selectively pivots the second hinge 200 and thereby angulates the lower segment 186 relative to the upper segment 184.

Preferably, the second hinge mechanism 200 is fixed to the lower segment 186 and the source of power includes an actuator 202 carried on the upper segment 184 for selectively angulating the lower segment relative to the upper segment.

Figure 6:
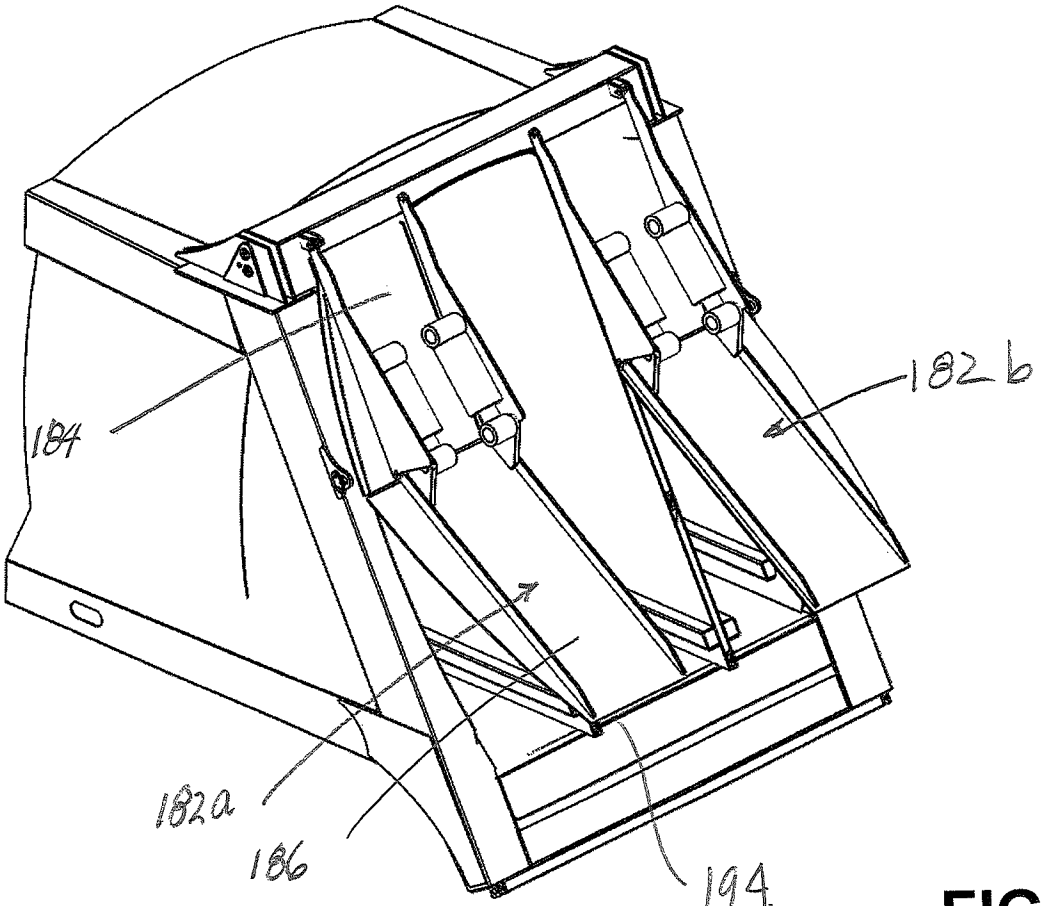
FIG. 6 is a view similar to FIG. 5, showing each shield in a normal packing mode of operation.
Figure 7:
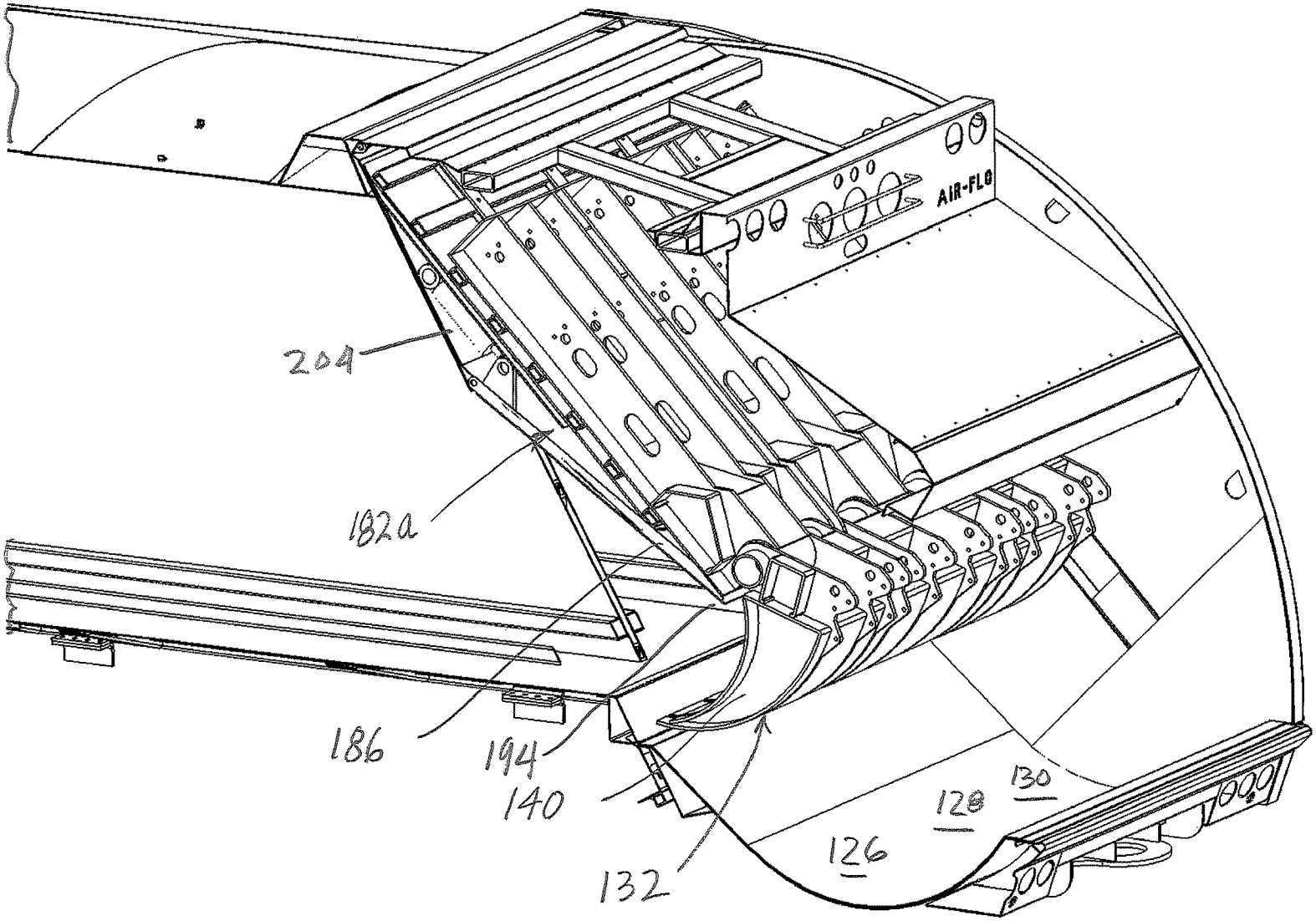
FIG. 7 shows the packing unit with pack blade and sweep blade, in relation to the shields in the normal packing position shown in FIG. 6.

In normal operation of an exemplary three-compartment rear load packer having a central and two side compartments, the lower hinged segment 186 of each shield guides refuse into the respective side compartment. FIGS. 6 and 7 show the bottom end 194 of the lower segment held slightly above the compartment floor so that the packing motion of the pack blade moves the sweep blades toward the lower segment with the working area of the sweep blade passing under bottom end 194 of the segment.

Figure 5:
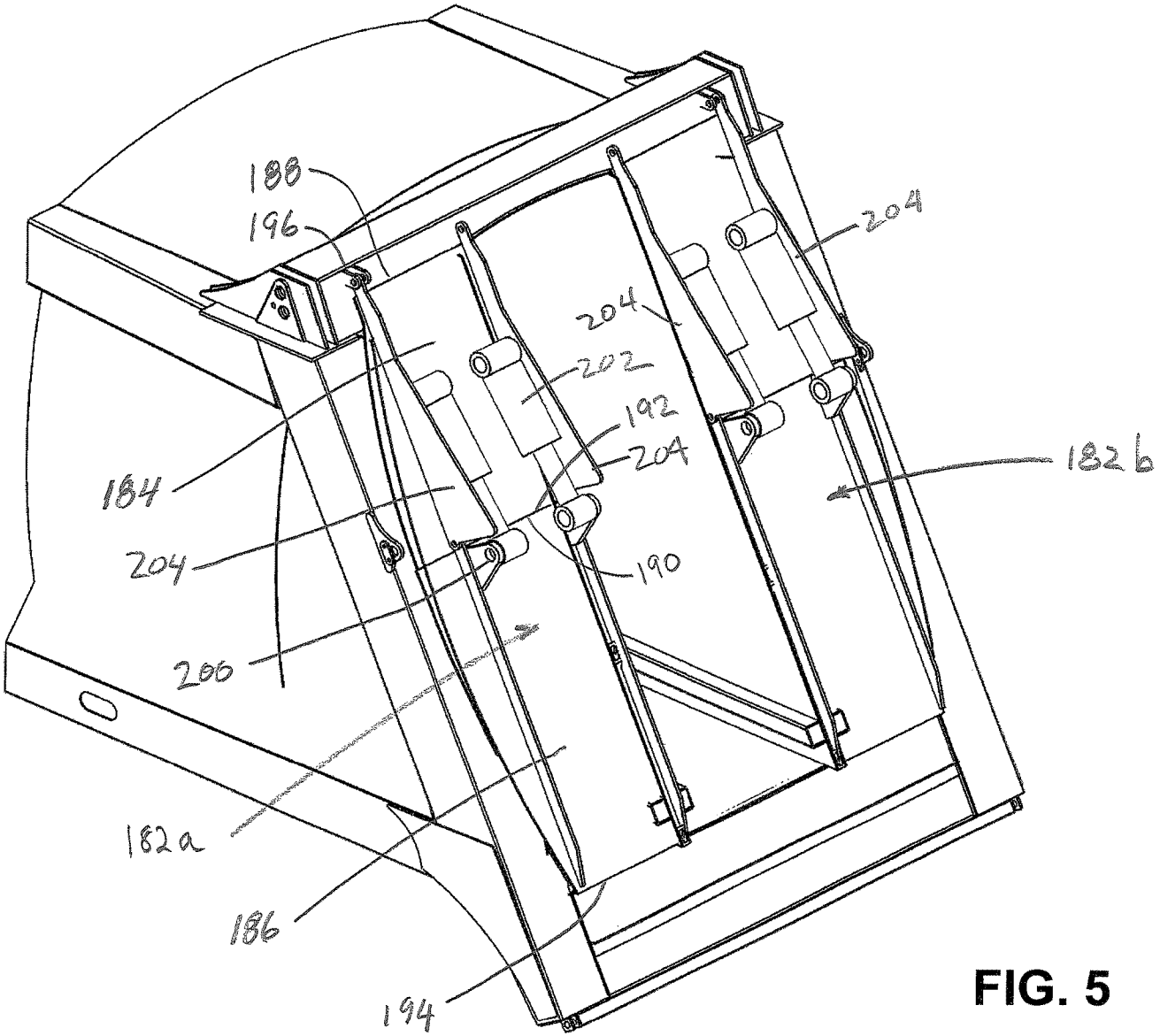
FIG. 5 is an oblique view of the rear of a three compartment body with both side compartments closed by respective composite shields according to an embodiment of the present invention.

When the body unloading procedure is begun, a set of hydraulic actuators 202, cylinders, rotary actuators, or the like close the lower segment 186 of each shield 182*a*, 182*b*, as shown in FIG. 5. This will facilitate the unloading of the main or center compartment of the body. Optionally, a mechanical device connected to the tailgate packing mechanism on the compaction unit can close the lower segments.

Figure 8:
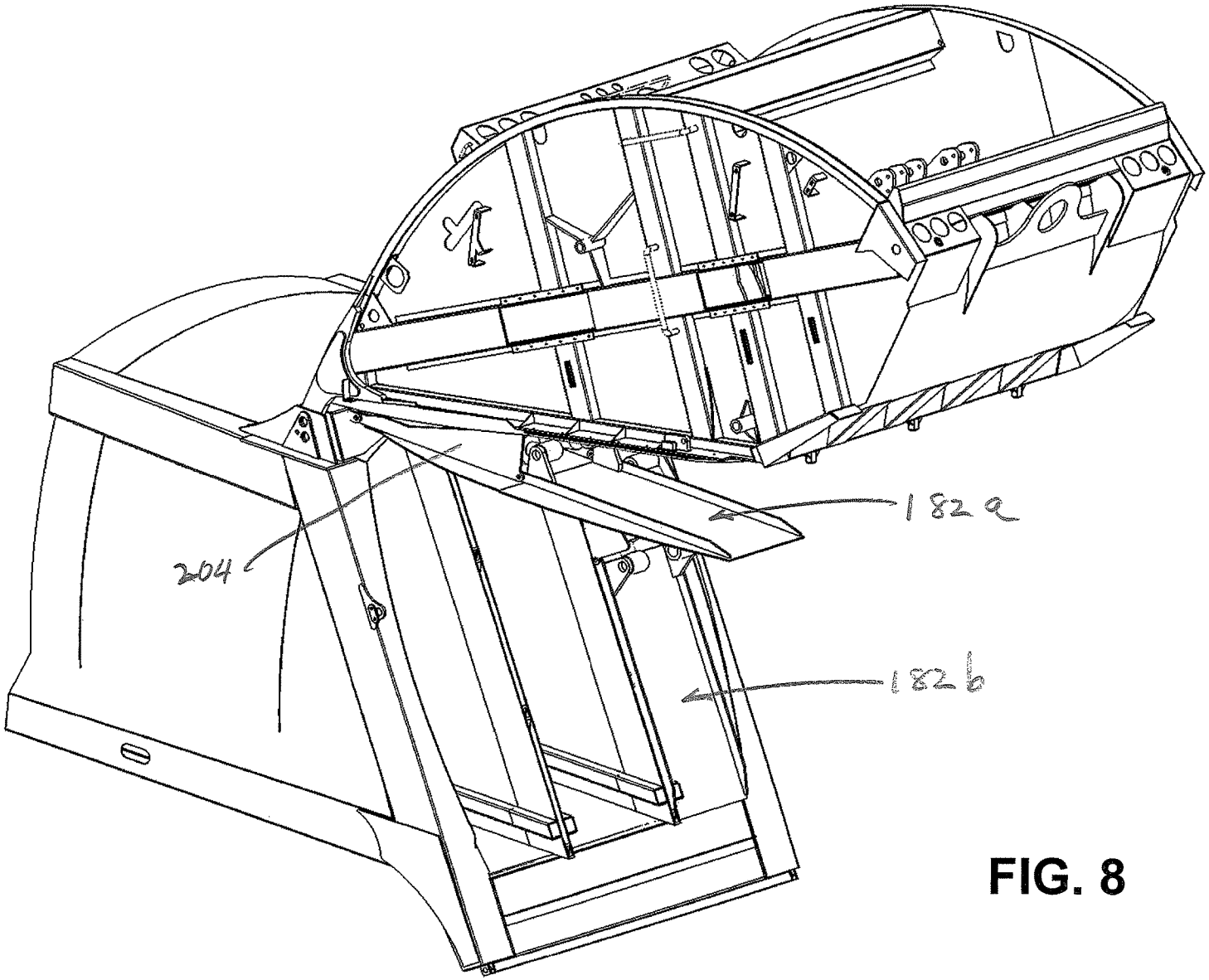
FIG. 8 shows the packing unit lifted away from the body, the center compartment having been unloaded, with one side compartment closed and the other side compartment opened for unloading.

When the truck has been re-located to empty one side compartment, the entire shield 182*a* of that compartment is unlatched from the body and freely pivotable upward to allow that compartment to unload, as shown in FIG. 8. This upward pivot can then be repeated for the shield 182*b* on the opposite side compartment in whichever order is the preferred method for unloading. If the refuse being pushed out of a given compartment does not apply sufficient force to passively swing and maintain the respective shield fully open to permit full removal of the refuse from the compartment, a brace between the shield and the body or a hook between the shield and the packing unit can be manually secured for the dumping mode.

The shield segment can be lowered to the guide position of FIG. 6 and the tailgate closed to prepare for loading again, as shown in FIG. 7. The tailgate will secure the shield between itself and the body. The raised side walls 204 on the upper segments 184 provide stop limits against the packing unit when in the raised position shown in FIG. 7 and FIG. 8. In FIG. 7, the dividing walls between the three sumps 126, 128, and 130 are omitted for clarity.

Figure 9:
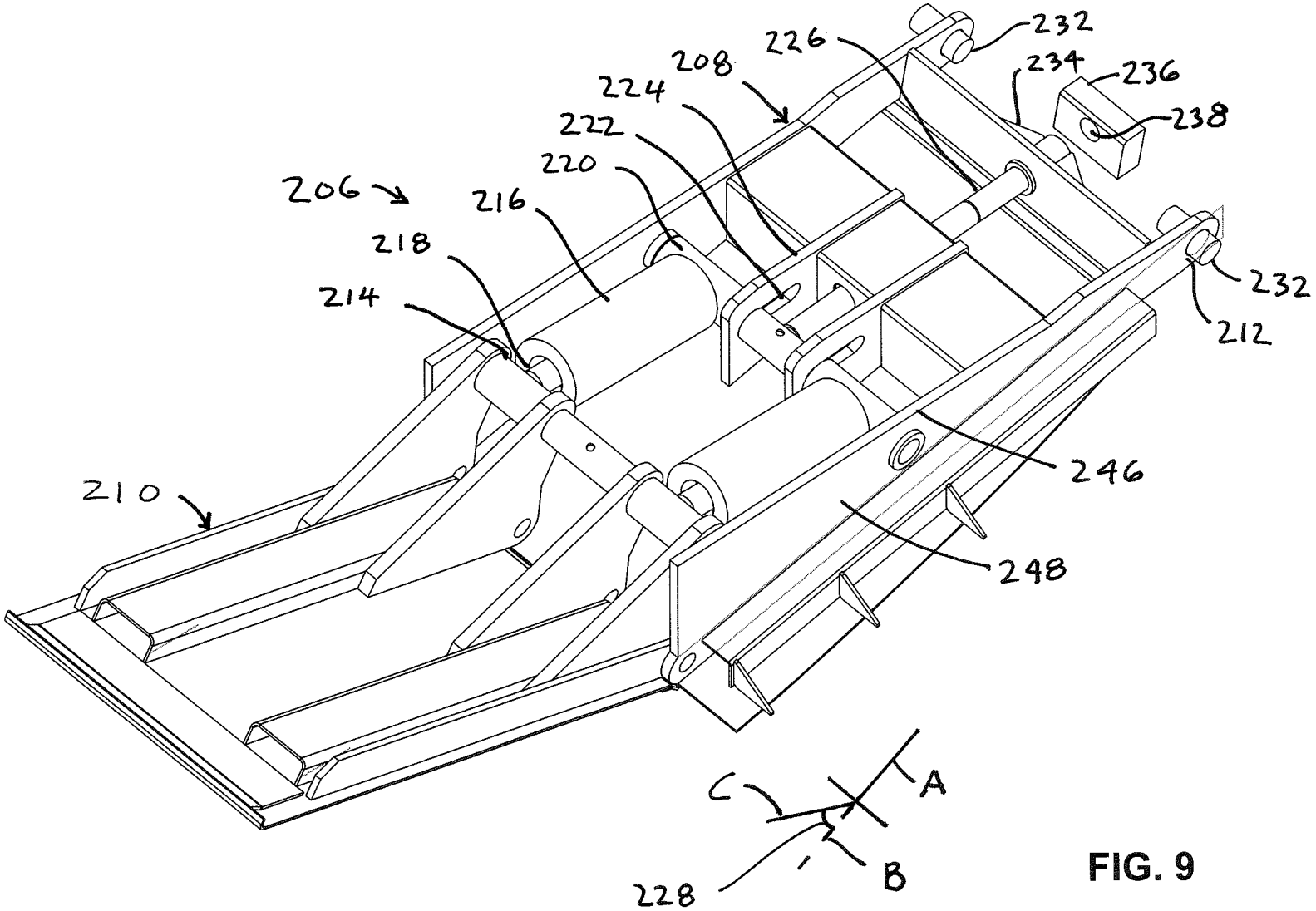
FIG. 9 shows a preferred implementation for each of these shields.

FIG. 9 shows an improved, preferred implementation for each of these shields 206. As previously described, each shield has an upper segment 208 and a lower segment 210, with a first hinge 212 at the top end of the upper segment and a second hinge 214 between the upper segment and the lower segment. Two actuation cylinders 216 with associated shafts 218 are mounted in the upper segment with a cross member 220 connecting the cylinders 216 and displaceable longitudinally (upwardly and downwardly) through slot 222 in bracket 224. The cross member 220 is mechanically connected to a longitudinal rod 226. In the configuration or position shown in FIG. 9, the upper segment 208 lies on a plane indicated at A, with its extension indicated by dotted line B, whereas the lower segment 210 lies in the plane indicated by C, forming an angle 228 that has a vertical component relative to plane A. In this configuration, the shield is free to pivot around axles 232 on the roof of the compartment, and the latching boss 234 is spaced from latching receptacle 236 with internal profile 238 which is also mounted on the compartment roof.

When the cylinders 216 are powered to move the lower segment 210 such that the lower segment is on a plane indicated at B', linearly aligned with the plane A' of the upper segment, the segments are substantially co-planer as indicated at 228'. As the cylinders 216 and associated shaft 218 are powered to the position showing in FIG. 10, the cross member 220 advances through slot 222, also advancing rod 226 which carries a latching pin 240. In the activated position shown in FIG. 10, the pin 240 is received within the mating profile 238 of receptacle 236 shown in FIG. 9. This prevents the upper segment from pivoting at 232.

It can thus be appreciated that a latch is situated at the top end of the upper segment 208 for selective activation and deactivation. The actuator 216 is operatively connected to the latch whereby the latch is activated or deactivated by the actuator simultaneously with the pivoting of the lower segment 210. The actuator pivots the lower segment between the closed position shown in FIG. 10 and the open position shown in FIG. 9, whereby in the open position the lower segment is angled vertically relative to the upper segment. In the closed position of the lower segment 208, the latch 240 is activated and in the open positon of the lower segment the latch is deactivated. In the presently illustrated embodiment, the latch mechanism is a pin 240 and an associated mating receptacle 236, but other forms of latching can be implemented for activation and deactivation produced by the same movement of the actuators that angulate the lower segment relative to the upper segment. In whatever form, the activated latch prevents the upper segment of the shield from pivoting around the hinge 212, and in the form shown, also maintains the upper segment in fixed relation to the body.

Figure 11:
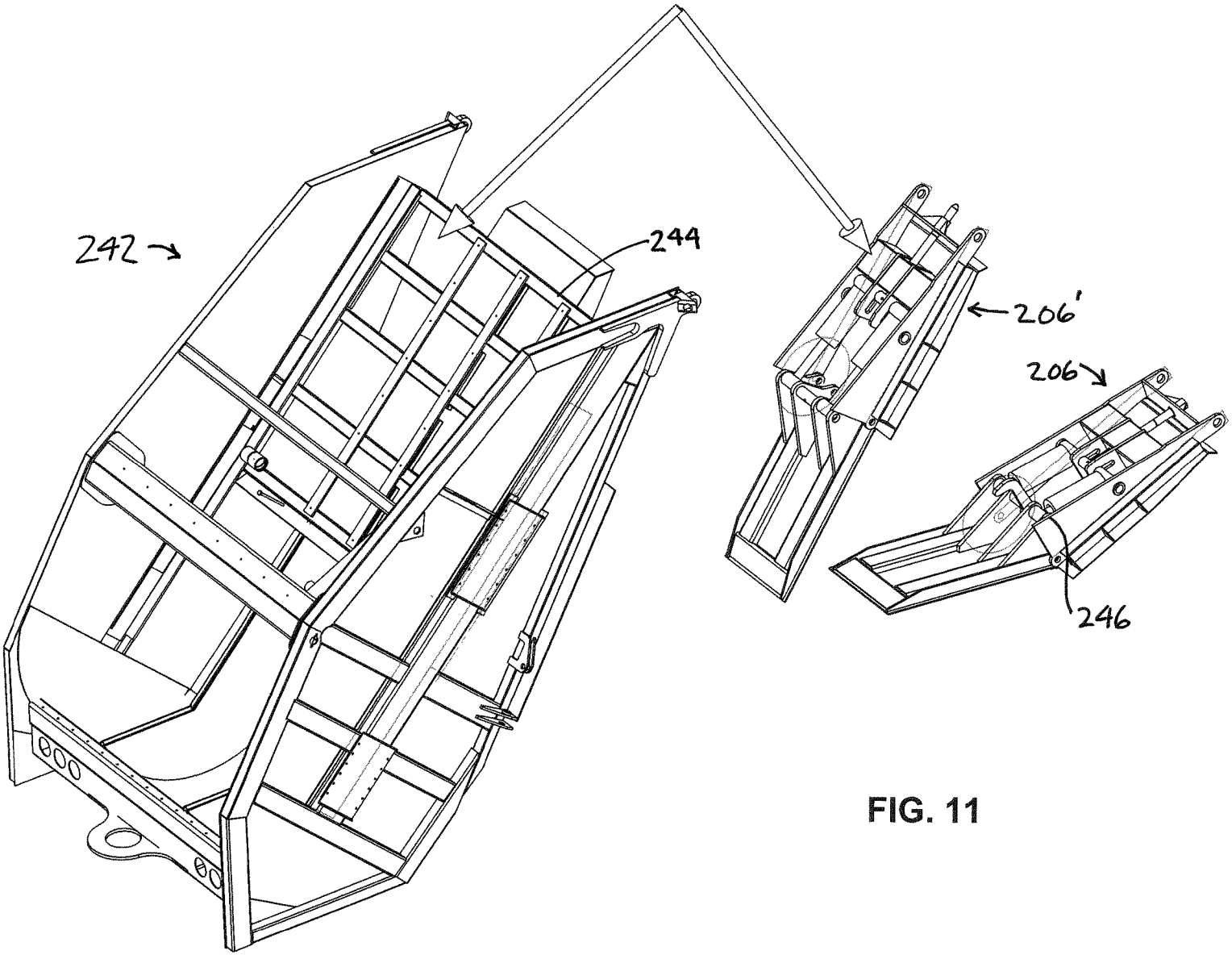
FIG. 11 shows another position of the actuating cylinders for angulating the shield segments.

FIG. 11 illustrates the open condition 206 and the closed condition 206' of the shield in relation to the packing unit 242. The underside of the packing unit includes a matrix or a similar substantially flat layer 244 which spans the width of the truck body and in one and optionally two modes of operation bears against the edges 246 of the tapered, vertical side plates 248 of the upper segment 208 each of the shields. One mode is for packing, with the lower segment open, and another optional mode fixes the lower segment in the closed position whereby the entire shield is closed for both side compartments during transport of a full truck to the dumping facility.

Figure 10:
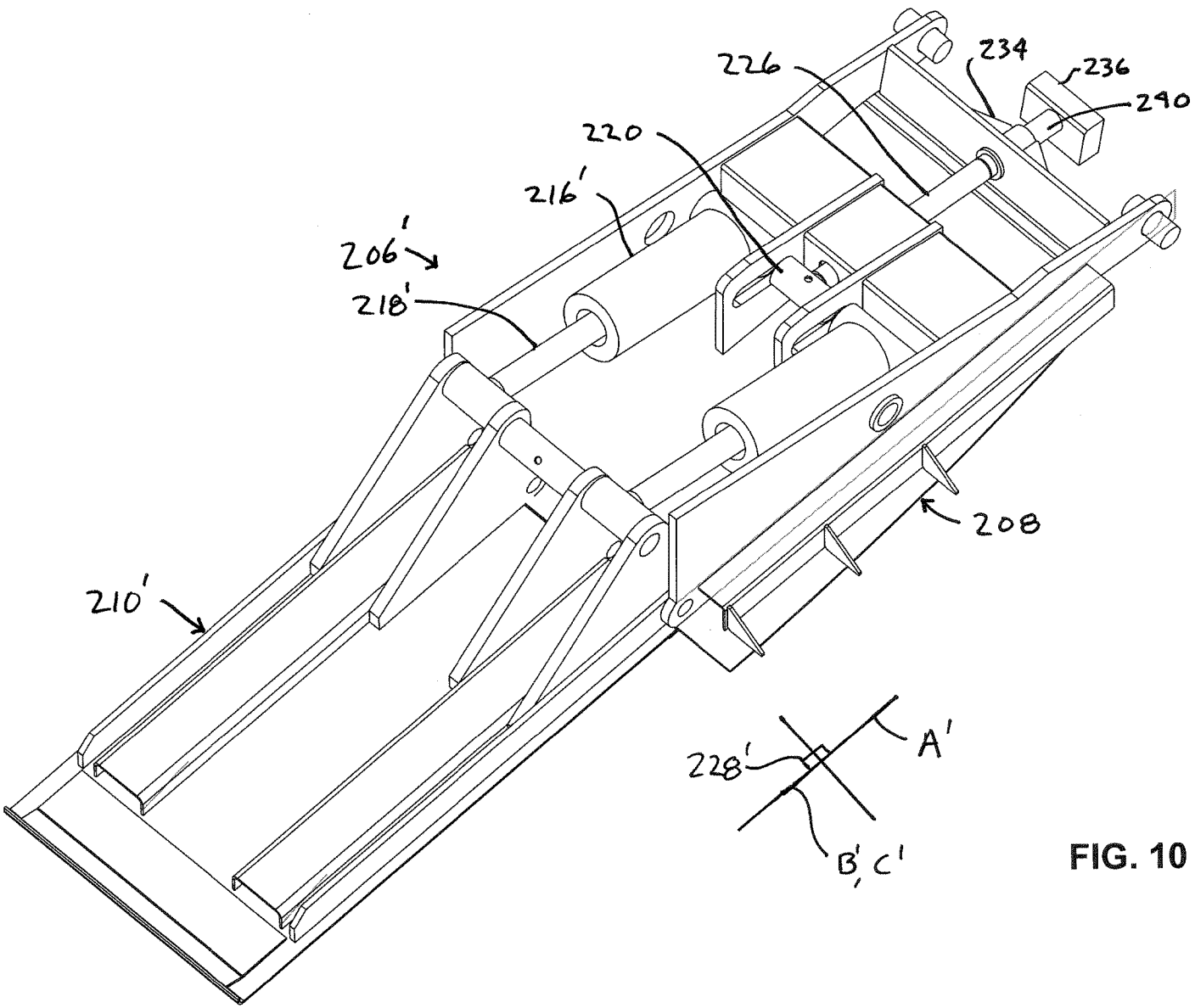
FIG. 10 shows one position of the actuating cylinders for angulating the shield segments.

Shields 206 have counterparts 182 in FIG. 8, which shows the dumping condition with the packing unit raised, center compartment having been fully discharged, the side compartment 182*a* fully open for discharge, while the other side compartment 182*b* is fully closed. Shield 182*a* is freely hinged at the top, whereas shield 182*b* is forced closed against its compartment. FIG. 9 shows the preferred condition 206 of shield 182*a* and FIG. 10 shows the preferred condition 206' of shield 182*b*.

Thus, the unpinned condition of the shield 206 depicted in FIG. 9 is present in two modes of operation: the packing mode depicted in FIG. 6, where the upper segment is fixed against the body by the matrix 244 on the packing unit and the lower segment is at a fixed angle above the compartment floor, and in the dumping mode where the upper segment freely pivots and the lower segment remains fixed at an angle 228 to the upper segment as the discharging refuse pushes up the shield. Similarly, the pinned condition of FIG. 10 is present in two closely related modes: the fully closed mode of operation depicted in FIG. 5 and the partially closed mode of operation depicted at 182*b* in FIG. 8.

As noted above, in the packing mode of operation the matrix 244 of the compaction unit preferably bears against the edges 246 of the upper segment to keep the upper segment closed against the upper region of the compartment. The elevation of the side walls or panels 248 at the hinge 214 between the upper segment and lower segment is such that the bottom edge of the lower segment when in the open position, avoids interference with the lower portion of the matrix. In an alternative embodiment a separate power source such as another cylinder, would keep the upper segment closed against the upper region of the compartment.

The invention claimed is:

1. A refuse truck body having a main compartment and at least one side compartment, with each compartment having an elongated rear opening extending obliquely from a roof edge to a floor edge at a rear of the truck body, and with a congruent elongated shield for the opening of each side compartment, wherein each shield comprises:

a rigid upper segment having a top end and an opposite bottom end, wherein the top end is hinged at the edge of the roof with a first pivot joint whereby the upper segment can angulate, about a central axis of the first pivot joint, toward and away from the opening, and wherein the central axis of the first pivot joint is fixed relative to the edge of the roof when the upper segment angulates toward and away from the opening;

a rigid lower segment that is hinged to the upper segment, having a top end confronting the bottom end of the upper segment as a second pivot joint, and extending to a bottom end at the edge of the floor;

a source of power for selectively pivoting the second joint between at least two positions including:

a first position having a first angle of articulation corresponding to a first mode of operation whereby the upper segment covers an upper region of the side compartment opening and the lower segment covers a lower region of the side compartment opening such that the shield covers the entire opening of the side compartment; and a second position having a second angle of articulation corresponding to a second mode of operation whereby the upper segment covers the upper region of the side compartment opening and the bottom end of the lower segment is positioned above the edge of the floor, such that refuse can be swept over the edge of the floor into the compartment through the lower region of the side compartment opening, beneath the lower segment;

wherein a sweep blade of the refuse truck is proximate the rigid lower segment, wherein the sweep blade comprises a section corresponding to the side compartment, wherein the sweep blade is configured to rotate towards the opening of the side compartment, and wherein the section of the sweep blade is configured to move through a collection sump associated with the side compartment.

2. The refuse truck body of claim 1, including a third mode of operation in which the upper and lower segments uncover the upper and lower regions of the compartment opening, whereby refuse can be freely dumped out of the compartment.

3. The refuse truck body of claim 1, wherein each side opening is rectilinear and each upper and lower segment is a rectilinear plate.

4. The refuse truck body of claim 3, wherein a perimeter of the upper segment is rectilinear and the plate is concave as viewed from within the side compartment.

5. The refuse truck body of claim 1, wherein a first hinge of the shield is passive.

6. The refuse truck body of claim 1, wherein in a third mode of operation the shield pivots at an upper hinge member as refuse is discharged out the respective compartment.

7. The refuse truck body of claim 1 in combination with a refuse compaction unit, wherein:

a single pack blade is pivotally connected to the sweep blade, wherein the sweep blade comprises a multi-section sweep blade;

the collection sump and two additional collection sumps are laterally separated by two laterally spaced dividing walls; and a drive system is operatively connected to the multi-section sweep blade for moving sweep blade sections of the multi-section sweep blade through the collection sumps.

8. The refuse truck body of claim 1 in combination with a refuse compaction unit, wherein the compaction unit is pivotable between a packing position corresponding to said second mode of operation and an unloading position corresponding to a third mode of operation; and in the second mode of operation, each shield is in the second position with the compaction unit holding the upper segment against the body while the lower segments of the shields are angulated upwardly.

9. The refuse truck body in combination with the refuse compaction unit of claim 8, wherein each compartment has an associated pushing device for discharging refuse from the compartment in the third mode of operation; and a first hinge of the shield is passive whereby in the third mode of operation the shield pivots at the first hinge as refuse is pushed out of the compartment against the shield.

10. The refuse truck body of claim 1 in combination with a refuse compaction unit, wherein the source of power is carried on the upper segment and is mechanically coupled to a second hinge member of the shield at the bottom end of the upper segment and to a latch member at the top end of the upper segment;

through said coupling at the bottom end of the upper segment, the source of power angulates the lower segment in selectively first or second positions of the at least two positions relative to the upper segment, with the second position angulated to a greater degree than the first position; and through said coupling at the top end of the upper segment, the source of power activates the latch member onto the truck body when the lower segment is angulated to the first position and deactivates the latch member from the truck body when the lower segment is angulated to the second position;

whereby when activated, the latch prevents the upper segment from angulating at the first pivot joint and when the latch is deactivated, the upper segment can freely rotate around the first pivot joint.

* * * * *